US006048100A

United States Patent [19]

Thrall et al.

[11] Patent Number: 6,048,100

[45] Date of Patent: Apr. 11, 2000

[54] RESEALABLE CLOSURE FOR A BAG

[75] Inventors: Ronald G. Thrall, Vancouver, Wash.; James M. Freeman; Wayne C. Piper, both of Omaha, Nebr.

[73] Assignee: Industrial Label Corp., Omaha, Nebr.

[21] Appl. No.: 09/265,688

[22] Filed: Mar. 10, 1999

[51] Int. Cl.[7] ..... B65D 33/18

[52] U.S. Cl. ..... 383/86; 383/85; 383/203; 383/906

[58] Field of Search ..... 383/62, 78, 81, 383/82, 84, 85, 86, 906

[56] References Cited

U.S. PATENT DOCUMENTS

| | | | |
|---|---|---|---|
| D. 380,964 | 7/1997 | Miller et al. . | |
| 1,920,321 | 8/1933 | Rosmait . | |
| 1,981,711 | 11/1934 | Russell . | |
| 2,197,490 | 4/1940 | Williams et al. | 383/203 X |
| 2,241,836 | 5/1941 | Wentz | 383/81 X |
| 2,373,744 | 4/1945 | Coghill | 383/81 X |
| 3,154,239 | 10/1964 | Madsen . | |
| 3,613,874 | 10/1971 | Miller . | |
| 3,982,574 | 9/1976 | Bianchi et al. . | |
| 4,441,613 | 4/1984 | Hain et al. . | |
| 4,483,445 | 11/1984 | Lepisto et al. . | |
| 4,638,912 | 1/1987 | Graf | 383/86 X |
| 4,690,322 | 9/1987 | Burns | 383/86 X |
| 4,824,261 | 4/1989 | Provost . | |
| 4,902,141 | 2/1990 | Linnewiel | 383/89 X |
| 4,911,563 | 3/1990 | Ciani | 383/89 |
| 4,913,293 | 4/1990 | Sanders . | |
| 4,946,289 | 8/1990 | Bolling et al. . | |
| 4,955,981 | 9/1990 | Provost . | |
| 5,035,518 | 7/1991 | McClintock | 383/81 X |
| 5,135,313 | 8/1992 | Bowman | 383/89 X |
| 5,597,634 | 1/1997 | Bloomer et al. | 383/81 X |
| 5,611,626 | 3/1997 | Warr . | |

*Primary Examiner*—Jes F. Pascua
*Attorney, Agent, or Firm*—Zarley, McKee, Thomte, Voorhees & Sease; Dennis L. Thomte

[57] ABSTRACT

A resealable closure for a bag is described wherein the bag has upper and lower ends and including a front wall member, a back wall member, and opposite side wall members. The lower end of the bag is sealed in conventional fashion. The upper ends of the wall members are folded downwardly adjacent the front wall member to form a flap which extends across the upper end of the bag with the upper flap being permanently sealed, by an adhesive, to the front wall member except for a flap portion adjacent one of the side wall members. The resealable closure is positioned between the flap portion and the front wall of the bag and permits the flap portion to be opened to form a pour opening in the upper corner of the bag. The flap portion may be resealed by the resealable closure. The closure is designed so that the contents of the bag will not come into contact with any sticky or tacky surface as the material is being poured from the bag.

12 Claims, 3 Drawing Sheets

RESEALABLE CLOSURE FOR A BAG

BACKGROUND OF THE INVENTION

1. Field of the Invention

This invention relates to a bag for containing a variety of particulate materials such as dog food, cat food, etc. More particularly, the invention relates to a resealable closure for a bag.

2. Description of the Related Art

Many types of bags have been previously designed for containing particulate materials such as dog food, cat food, etc. Normally, the bags for cat and dog food range in size from one pound bags to fifty pound bags. The conventional bags normally have a front wall member, a back wall member and opposite side wall members, with each of the wall members having upper and lower ends. Normally, the lower ends of the wall members are folded upwardly to form a flap which is sealed to either the back wall member or the front wall member to close the lower end of the bag. The upper end of the bag is also normally closed by folding the upper ends of the wall members downwardly to create a flap which is sealed to either the front wall member or the back wall member. When it is desired to pour the contents from the conventional bag, the upper flap is usually torn open, or a corner of the bag is ripped open, to enable a portion of the contents to be dispensed or poured therefrom. It is then difficult to reseal or reclose the bag after a portion of the contents has been poured therefrom.

SUMMARY OF THE INVENTION

A resealable closure for a bag is described wherein the bag has upper and lower ends with the bag including a front wall member having opposite side edges, a back wall member having opposite side edges, and side wall members extending between the side edges of the front and back wall members. When the bag is initially fabricated, the side wall members are folded inwardly between the front and rear wall members. The lower ends of the wall members are folded to form a lower flap which is sealed to either the front wall member or the back wall member to close the lower end of the bag. The upper ends of the wall members are folded downwardly adjacent the front wall member to form a flap which extends across the upper end of the bag. The upper flap is permanently sealed, by an adhesive, to the front wall member except for a flap portion adjacent one of the side wall members. The flap portion is selectively movable between open and closed positions. The flap portion, when moved to its open position, creates a pour opening in the upper end of the bag adjacent the one side wall member to enable material in the bag to be poured therefrom through the pour opening. A resealable closure having an upper end, a lower end, opposite side edges, a front portion and a back portion is provided and has its upper front end adhesively secured to the back wall member in the unsealed flap portion with the upper end of the closure being positioned between the back wall member in the flap portion and the front wall member. The closure is selectively movable between an unsealed open position and a sealed closed position. The closure, when initially fabricated, is provided with a first release liner at its back portion which is adhesively secured, by a first adhesive, to a polyester sheet member having a second adhesive on its back surface which is initially covered with a second release liner which is removed prior to the closure being secured to the bag. The polyester sheet member and the first adhesive thereon remains on the front wall member when the closure and the flap portion are moved form their closed position to their open position. The first release liner is comprised of a non-stick material so that the material being poured from the bag will not adhere thereto. The first adhesive will not come into contact with the material being poured from the bag, since it is positioned on the front wall member and is not in the flow path of the material being poured from the bag.

It is therefore a principal object of the invention to provide an improved resealable closure for a bag.

Yet another object of the invention is to provide a bag including a resealable closure which may be opened to form a pour opening in one of the corners of the bag with the closure being designed so that the material being poured from the bag will not adhere to any sticky or tacky surface associated with the resealable closure.

Still another object of the invention is to provide a novel closure for a resealable bag.

Yet another object of the invention is to provide a bag having a resealable closure which is economical of manufacture and refined in appearance.

These and other objects will be apparent to those skilled in the art.

DESCRIPTION OF THE PREFERRED EMBODIMENT

Figure 1:
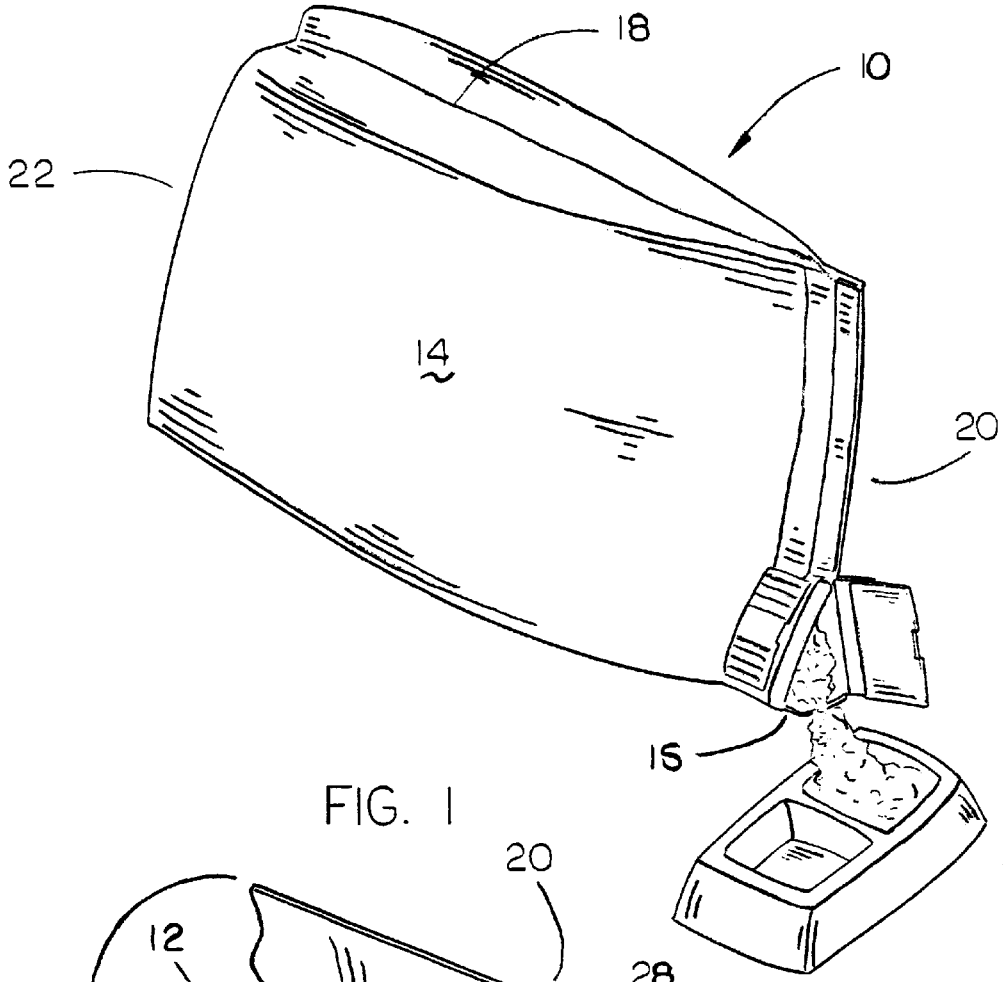
FIG. 1 is a perspective view illustrating material being poured from a bag having the resealable closure of this invention associated therewith.
Figure 2:
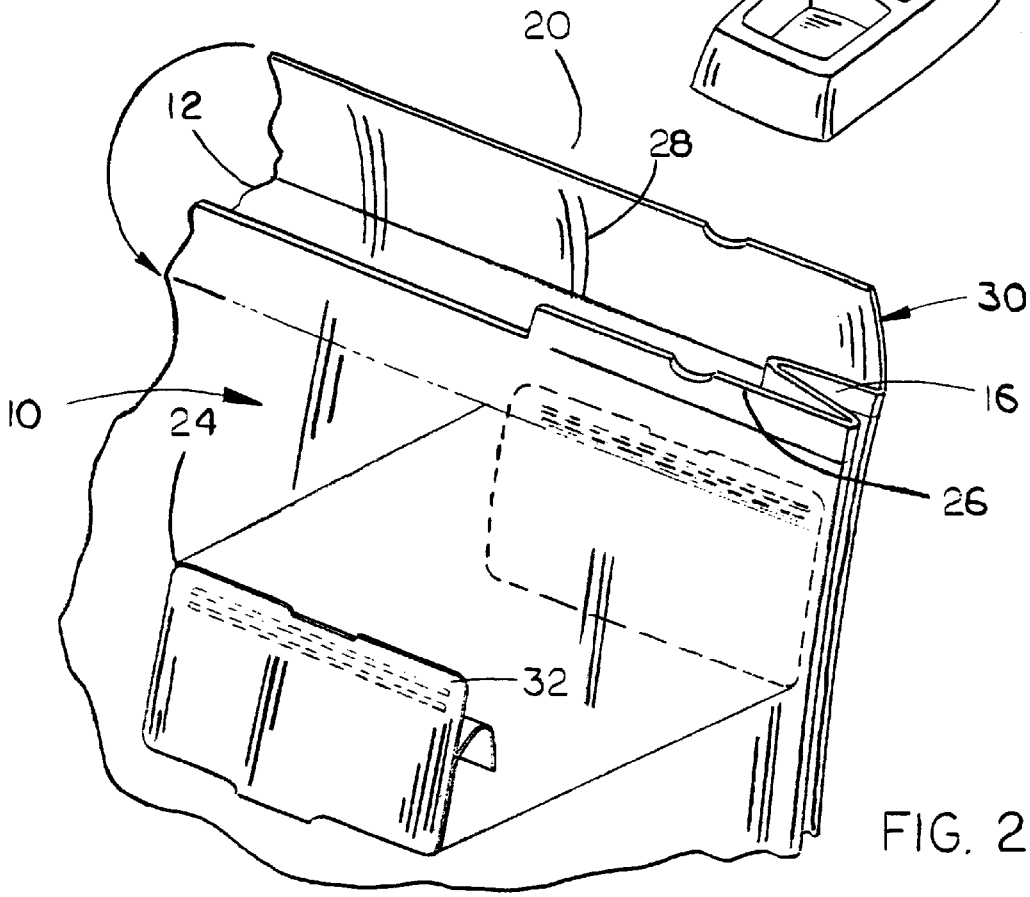
FIG. 2 is a perspective view illustrating the manner in which the resealable closure is positioned on the bag.

The numeral 10 refers to a bag for dog food, cat food, or other particulate material which includes a back wall 12, a front wall 14, and a pair of expandable (foldable) side walls 16 and 18 which extend between walls 12 and 14, as illustrated in the drawings. For purposes of description, bag 10 will be described as having an upper end 20 and a lower end 22. In most cases, the bag 10 is comprised of a plurality of layers of paper and/or polyester. Further, in conventional bags, the lower end of the bag is sealed, usually by folding the lower ends of the front wall, back wall, and side walls upon themselves to form a flap which is glued or sealed to the lower end of the back wall 12. The lower end of the front wall usually terminates slightly below the lower ends of the side wall members and the back wall for sealing purposes. Normally, the upper end of the front wall 14 and the upper ends of the side walls terminate below the upper end of back wall 12 for conventional sealing purposes. The upper end of the conventional bag is normally sealed by folding the upper ends of the back wall 12, front wall 14, and the side walls 16 and 18 upon themselves to form a flap which is positioned adjacent at the upper end of the front wall.

The resealable closure of this invention is referred to generally by the reference numeral 24 and is designed to be used with a conventional bag, as previously described, except that the flap 26 formed at the upper end of the bag 10 is preferably perforated at 28 to define a flap portion 30, as will be described in more detail hereinafter. Flap 26, except for flap portion 30, is preferably glued to front wall 14 in conventional fashion. A glue line 32 is provided on the inside surface of the upper end of back wall 12 in flap portion 30 to enable closure 24 to be glued thereto, as will be described hereinafter. Although the closure 24 is illustrated as being positioned at the upper end of the bag, closure 24 could be provided at the lower end of the bag if so desired.

Closure 24 is generally rectangular in shape, although it is possible that other shapes could also be utilized. Closure 24 includes a sheet member 34 having an upper end 36, lower end 38, opposite side edges 40 and 42, front surface 44 and back surface 46. Preferably, sheet member 34 is comprised of an 80 lb. semi-gloss, coated one-side bleached kraft face paper stock. A possible alternative to the construction of sheet member 34 could be various weights in both a coated one or two-side bleached kraft paper face stock. Sheet member 34 could also be comprised of an uncoated litho kraft stock in the same weights.

The back surface 46 of sheet member 34 is secured to a release liner 48 by an adhesive 50. Preferably, release liner 48 is comprised of a 1.42 mil polyester material. Release liner 48 could have a thickness varying from 1.0 to 2.0 mils and could be manufactured from a polypropylene or polystyrene film or blend thereof. Adhesive 50 is preferably a hot melt rubber-based adhesive which adhesively secures sheet member 34 to release liner 48. Adhesive 50 could be comprised of an acrylic or solvent-based adhesive, if so desired.

Figure 5:
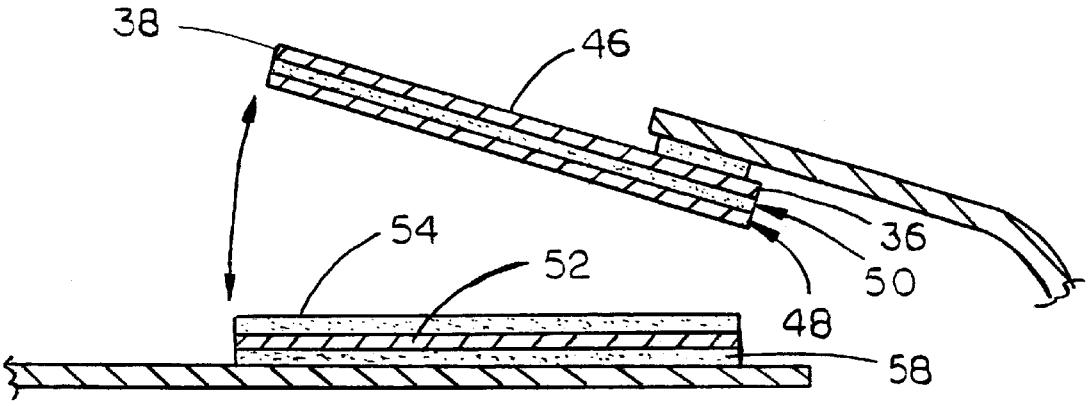
FIG. 5 is a view similar to FIG. 4, but which illustrates the manner in which the closure operates to permit the flap portion to be opened.
Figure 7:
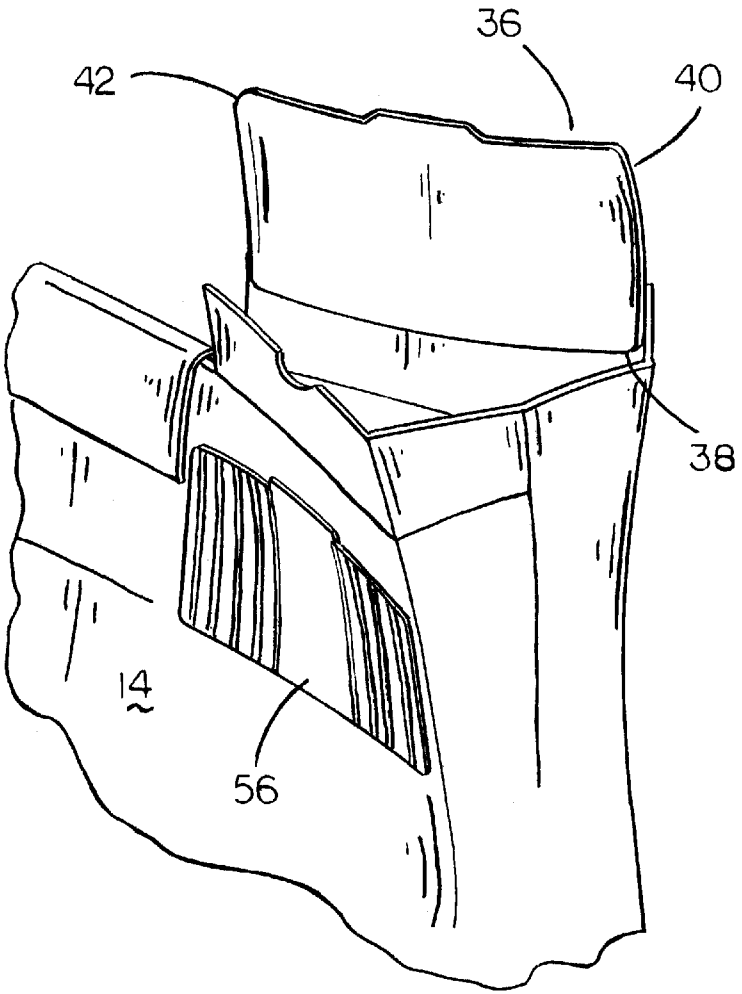
FIG. 7 is a view similar to FIG. 6 except that the flap portion has been opened to create a pour opening in the bag.
Figure 6:
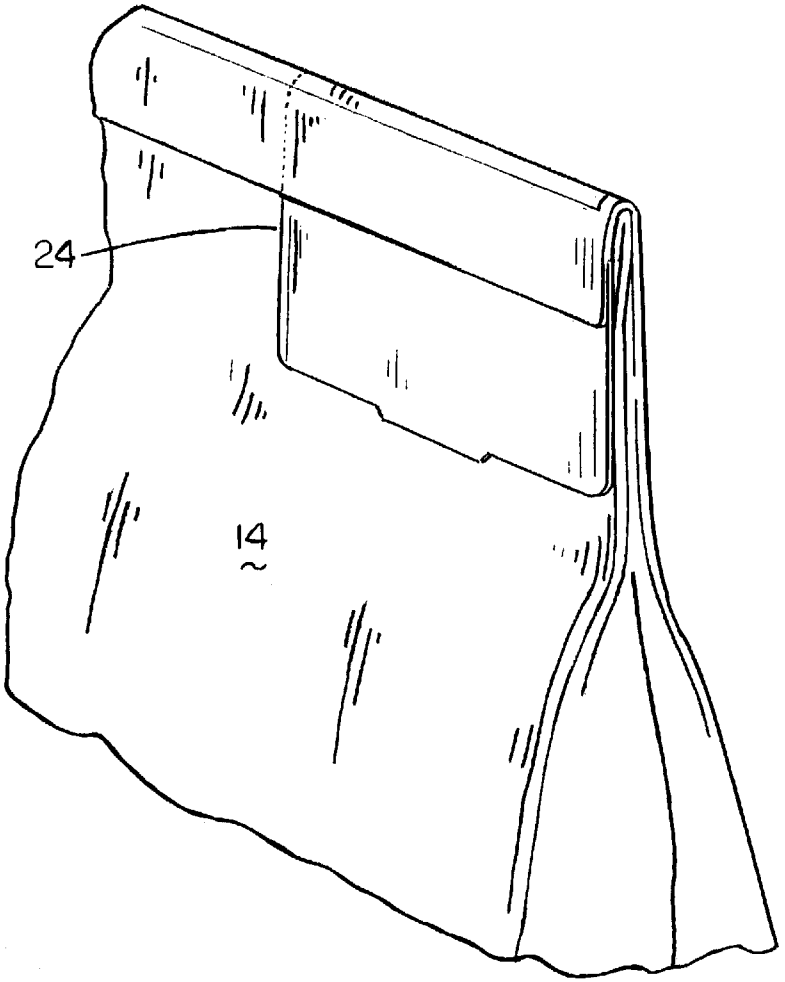
FIG. 6 is a partial perspective view illustrating the bag in its initial closed and sealed position.

The back surface of release liner 48 is adhesively secured to sheet member 52 by adhesive 54. Preferably, sheet member 52 is comprised of a 2.0 mil polyester film. The thickness of sheet member 52 could vary in thickness from 1.0 to 2.0 mils and could be constructed of a polypropylene or polystyrene film or blend thereof. Adhesive 54 is preferably a hot melt rubber-based adhesive which temporarily holds release liner 48 to sheet member 52. Adhesive 54 is patterned in lines or strips to allow easy removal of release liner 48 therefrom while having good aggressive reseal capabilities. Adhesive 54 is provided with a deadened area 56 to allow easy gripping of the layers of material thereabove, as viewed in FIG. 5, for removal. Adhesive 54 could also be comprised of an acrylic or solvent-based adhesive if so desired. The deadened area or areas 56 could be provided at the lower corners of the closure or other locations if so desired. Further, one or more flaps without adhesive could extend from closure 24 to facilitate the closure being moved from its sealed closed position to its unsealed open position.

Figure 3:
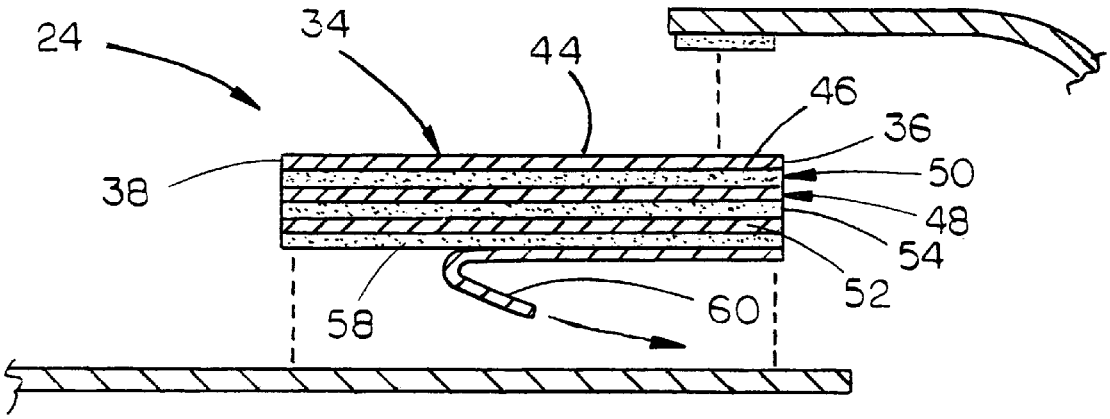
FIG. 3 is an exaggerated sectional view illustrating the manner in which the closure is initially positioned between the front wall member of the bag and the flap portion of the upper flap of the bag.
Figure 4:
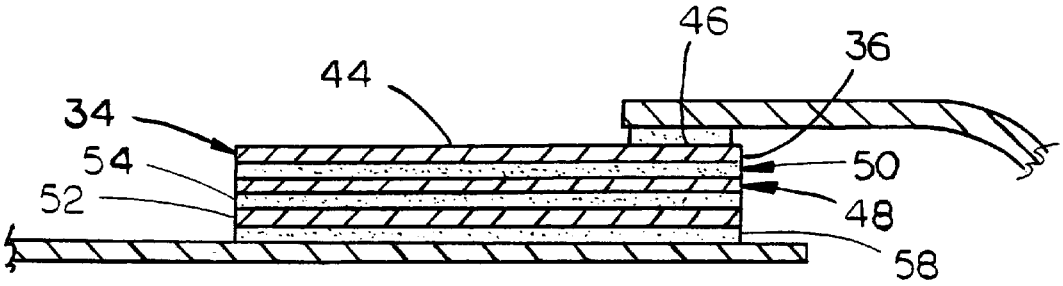
FIG. 4 is a view similar to FIG. 3 except that the flap portion has been secured to the front wall member of the bag by means of the closure of this invention.

The back surface of sheet member 52 (the bottom surface of sheet member 52 as viewed in FIGS. 3–5) has an adhesive 58 thereon which is preferably comprised of a hot melt rubber-based adhesive. Adhesive 58 could also be comprised of an acrylic or solvent-based adhesive. The numeral 60 refers to a release liner which is adhered to the adhesive 58 during fabrication of the closure 24. When the closure 24 is to be secured to the bag 10, the release liner 60 is removed and discarded. Release liner 60 is preferably comprised of a 40 lb. bleached kraft stock material.

Set forth hereinbelow are the specifications for the various components of the closure 24:

| | PREFERRED |
|---|---|
| SHEET MEMBER 34 | |
| 80# semi-gloss, coated one side | 80# |
| Caliper (mils) | 4.8 |
| Tear, MD (grams) | 83 |
| Tear, CD (grams) | 91 |
| Tensile, MD (lbs/in.) | 46 |
| Tensile, CD (lbs/in.) | 22 |
| ADHESIVE 50 | |
| A106 (General Purpose Permanent) | |
| Coating weight (lbs/3000 $FT^2$) | 10 ± 2 |
| Min. application temp. (°F.) | +40 |
| Service temp. (°F.) | −50 to +150 |
| FDA conformance | 175.105 |
| RELEASE LINER 48 | |
| Clear polyester liner | |
| Caliper (mils) | 1.5 |
| ADHESIVE 54 | |
| A301 | |
| Coating weight (lbs/3000 $FT^2$) | 15 ± 2 |
| Min. application temp. (°F.) | +40 |
| Service temp. (°F.) | −50 to +150 |
| FDA conformance | 175.105 |
| SHEET MEMBER 52 | |
| Clear polyester | |
| Caliper (mils) | 2.0 |
| Tensile, MD (PSI) | 30000 |
| Elongated MD (%) | 130 |
| Elongation at break CD (%) | 50 |
| ADHESIVE 58 | |
| A106 (General Purpose Permanent) | |
| Coating weight (lbs/3000 FT2) | 13 ± 2 |
| Min. application temp. (°F.) | +40 |
| Service temp. (°F.) | −50 to +150 |
| FDA conformance | 175.105 |
| RELEASE LINER 60 | |
| 40# C/S (L2) | |
| Basis weight (lbs/24 × 36 - 500) | 42 |
| Caliper (mils) | 2.5 |
| Tear, MD (grams) | 34 |
| Tear, MD (grams) | 40 |
| Tensile, MD (lbs/in.) | 31 |
| Tensile, MD (lbs/in.) | 14 |

Closure 24 is installed on the bag 10 during the manufacture thereof and usually before the bag has been filled with the particulate material. Flap 26 is held in place by an adhesive in conventional fashion. Glue line 52 adhesively secures the inside surface of the upper end of back wall 12 to the upper end of front surface 44 of sheet member 34. Sheet member 52 of the closure 24 is secured to the front wall 14 of bag 10 by the adhesive 58. Release liner 48 of closure 10 is releasably secured to sheet member 52 by the adhesive strips 54. Thus, closure 10 initially seals the flap portion 30 to the front wall 14.

When it is desired to pour some of the contents of the bag 10 therefrom, the closure 24 is grasped at the deadened areas and pulled outwardly and upwardly from the bag 10 which causes flap portion 30 to separate from flap 26 at the perforated line 28 to form a pour opening at the upper end of the bag 10 adjacent side wall 16.

As upward and outward force is applied to the closure 24 during the opening process, release liner 48 separates from the adhesive strips 54 which remain on the sheet member 52 which is adhesively secured to front wall 14. The release liner 48 separates from adhesive 54 inasmuch as the binding adhesive strength between release liner 48 and adhesive 54 is less than the binding adhesive strength between adhesive 54 and sheet member 52 and less than the binding adhesive strength of the adhesive strength of the adhesive 58 which secures sheet member 52 to bag 10. During the opening process, sheet member 34 does not separate from release liner 48, since the binding adhesive strength of adhesive 50 is greater than the force required to separate release liner 48 from adhesive 54.

When the closure 24 has been opened to form the pour opening, the material being poured from the bag 10 will not stick or adhere to the closure 24, since the only portion of the closure 24 which comes into contact with the material is the release liner 48 which is not sticky or tacky. The material does not come into contact with the adhesive 54, since it remains on the front wall 14 of bag 10 below the pour opening.

The bag 10 may then be resealed by simply bringing the release liner 48 into engagement with the adhesive 54 which closes the closure and the flap portion 30.

Thus it can be seen that the invention accomplishes at least all of its stated objectives

We claim:

1. In combination:

a bag, having upper and lower ends, for containing materials therein;

said bag including a front wall member having opposite side edges, a back wall member having opposite side edges, and side wall members extending between the side edges of said front and back wall members;

said wall members having upper and lower ends;

said lower ends of said wall members being sealed to close said lower end of said bag;

said upper ends of said wall members being folded downwardly adjacent said front wall member to from a flap which extends across the upper end of said bag;

said flap being sealed to said front wall member except for a flap portion adjacent one of said side wall members;

said flap portion being selectively movable between open and closed positions;

said flap portion, when moved to its open position, creating a pour opening in said upper end of said bag adjacent said one side wall member to enable material in said bag to be poured therefrom through said pour opening;

a resealable closure having an upper end, a lower end, opposite side edges, a front portion, and a back portion;

said closure having its upper front end operatively secured to said upper end of said back wall member and being positioned between said flap portion and said front wall member;

said closure being selectively movable between an unsealed open position and a sealed closed position;

said closure having a first adhesive at its said back portion which adhesively secures said closure and said flap portion to said front wall member when said closure is in its said sealed closed position;

said first adhesive remaining on said front wall member when said closure is moved from its sealed closed position to its unsealed open position whereby the contents of said bag, when being poured from said bag, through said pour opening, will not come into contact with said first adhesive.

2. The combination of claim 1 wherein said closure includes a release liner at its back portion which normally adheres to said first adhesive when said closure is in its said sealed closed position, but which releases, upon a predetermined amount of separation force being applied thereto, from said first adhesive when said closure is moved from its said closed position to its said open position.

3. The combination of claim 2 wherein said release liner comprises a non-stick material whereby the material being poured from said bag will not adhere thereto.

4. The combination of claim 1 wherein a second adhesive secures said release liner to said back portion of said closure.

5. The combination of claim 4 wherein the adhesive strength of said second adhesive is greater than the adhesive strength of said first adhesive.

6. The combination of claim 5 wherein said first adhesive is positioned between said release liner and a sheet member, having a front portion and a back portion; said back portion of said sheet member having a third adhesive at its back portion which adhesively secures said sheet member to said front wall member of said bag.

7. The combination of claim 6 wherein said third adhesive has a greater adhesive strength than said first adhesive.

8. The combination of claim 7 wherein said third adhesive comprises a permanent adhesive.

9. The combination of claim 7 wherein said first adhesive comprises a plurality of spaced-apart adhesive strips.

10. The combination of claim 1 wherein the upper front end of said closure is adhesively secured to said flap portion.

11. The combination of claim 1 wherein said closure comprises a label.

12. The combination of claim 9 wherein deadened areas are provided in said plurality of adhesive strips to enable said closure to be grasped.

* * * * *

UNITED STATES PATENT AND TRADEMARK OFFICE

CERTIFICATE OF CORRECTION

PATENT NO. : 6,048.100

DATED : April 11, 2000

INVENTOR(S) : Ronald G. Thrall, James M. Freeman, Wayne C. Piper

It is certified that error appears in the above-identified patent and that said Letters Patent are hereby corrected as shown below:

Column 5, line 39, please delete the misspelling "from" and substitute therefor -- form --.

Signed and Sealed this

Third Day of April, 2001

*Attest:*

Nicholas P. Godici

NICHOLAS P. GODICI

*Attesting Officer*

*Acting Director of the United States Patent and Trademark Office*